US006795102B2

(12) United States Patent
Kokubo et al.

(10) Patent No.: US 6,795,102 B2
(45) Date of Patent: Sep. 21, 2004

(54) THERMAL PRINTER HAVING SHUTTER UNIT

(75) Inventors: Hideyuki Kokubo, Saitama (JP); Tomoko Taki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/360,735

(22) Filed: Feb. 10, 2003

(65) Prior Publication Data

US 2003/0151656 A1 Aug. 14, 2003

(30) Foreign Application Priority Data

Feb. 8, 2002 (JP) ..... 2002-032535

(51) Int. Cl.[7] ..... B41J 33/00
(52) U.S. Cl. ..... 347/175
(58) Field of Search ..... 347/175, 172; 349/21, 20; 400/120.03; 399/154

(56) References Cited

U.S. PATENT DOCUMENTS 5,216,438 A * 6/1993 Nakao et al. ..... 347/172
5,216,466 A * 6/1993 Mitani ..... 399/154
5,548,420 A * 8/1996 Koshimizu et al. ..... 349/21
6,480,515 B1 11/2002 Wilson
6,552,756 B1 * 4/2003 Kotani et al. ..... 349/20
2003/0063181 A1 4/2003 Taki et al.

FOREIGN PATENT DOCUMENTS

JP 10/067128 3/1998

* cited by examiner

*Primary Examiner*—K. Feggins
(74) *Attorney, Agent, or Firm*—Sughrue Mion, PLLC

(57) ABSTRACT

A color thermal printer includes feeder rollers for feeding thermosensitive recording material through a feeding path. A thermal head operates for thermal recording of an image in a recording region of the recording material being fed. An unused region is defined outside the recording region. A photo fixer fixes the image on the recording material by application of ultraviolet or violet rays thereto. A liquid crystal shutter unit is disposed between the photo fixer and the recording material, and includes plural shutter segments. The plural shutter segments are arranged in a form of plural parallel lines, and changeable independently between an opaque state and a transparent state, and when in the opaque state, block the ultraviolet or violet rays, and when in the transparent state, cause the rays to pass. A controller controls the liquid crystal shutter unit in synchronism with the feeder rollers, sets at least one of the shutter segments in the transparent state if the at least one is opposed to the recording region in feeding of the recording material, and sets at least one of the shutter segments in the opaque state if the at least one is opposed to the unused region in feeding of the recording material.

8 Claims, 3 Drawing Sheets

THERMAL PRINTER HAVING SHUTTER UNIT

BACKGROUND OF THE INVENTION

1. Field of the Invention

The present invention relates to a thermal printer having a shutter unit. More particularly, the present invention relates to a thermal printer having a shutter unit with which fixing rays from a photo fixer can be adjusted, and recording material can be used effectively without waste.

2. Description Related to the Prior Art

A color thermal printer is used with color thermosensitive recording material, which includes a support and at least three thermosensitive coloring layers overlaid thereon. The coloring layers are yellow, magenta and cyan coloring layers. Among the three, the yellow coloring layer is positioned the farthest from the support, and has the highest heat sensitivity. The cyan coloring layer is positioned the nearest to the support, and has the lowest heat sensitivity.

The thermal printer includes feeder rollers, a thermal head, a photo fixer and the like. The feeder rollers feed the recording material. The thermal head presses and heats the recording material, to develop color. The photo fixer accommodates an electromagnetic source, and emits electromagnetic fixing rays. The thermal head and the photo fixer are arranged in a feeding direction of the recording material.

A certain type of the thermal printer is used with the recording material in a continuous form that is wound in a form of a recording material roll. In the thermal printer, the recording material is unwound from the recording material roll, and subjected to thermal recording and photo fixation. A recording region of the recording material is provided with a full-color image, and cut by a cutter to obtain a sheet as a print. The sheet is ejected from the thermal printer. An unused region of the recording material remaining after the cutting is wound back to the recording material roll. The unused region having been adjacent to the sheet will be used in next operation of printing.

To fix the recording region in a regularized manner electromagnetically, the fixing rays must be applied to the recording region until a rear end of the recording region moves past the photo fixer. However, the fixing rays are applied also to the unused region. The unused region cannot be used for next operation of producing a print. This is waste of the recording material. In view of this, there is a suggestion in JP-A 10-067128, in which the thermal printer has a mechanical shutter for inserting a shutter screen in a space between the photo fixer and the recording material in synchronism with feeding of the recording material. This prevents the fixing rays from striking the unused region.

However, the mechanical shutter disclosed in the above document is structurally complicated due to the great number of incorporated parts. Efficiency in using a space is specifically low because of the mechanical shutter. A size of the thermal printer becomes remarkably large.

SUMMARY OF THE INVENTION

In view of the foregoing problems, an object of the present invention is to provide a thermal printer having a shutter unit with which fixing rays from a photo fixer can be adjusted, and recording material can be used effectively without waste.

In order to achieve the above and other objects and advantages of this invention, a thermal printer includes a feeder for feeding thermosensitive recording material through a feeding path. A thermal head operates for thermal recording of an image in a recording region of the recording material being fed, wherein an unused region is defined outside the recording region. A photo fixer fixes the image on the recording material by application of electromagnetic rays thereto. A liquid crystal shutter unit is disposed between the photo fixer and the recording material, and includes plural shutter segments, wherein the plural shutter segments are arranged in a predetermined pattern, and changeable between an opaque state and a transparent state independently from one another, and when in the opaque state, block the electromagnetic rays, and when in the transparent state, cause the electromagnetic rays to pass. A controller controls the liquid crystal shutter unit in synchronism with the feeder, sets at least one of the shutter segments in the transparent state if the at least one is opposed to the recording region in feeding of the recording material, and sets at least one of the shutter segments in the opaque state if the at least one is opposed to the unused region in feeding of the recording material.

The recording material is continuous, supplied in a wound form of a recording material roll, and the unused region is positioned nearer to the recording material roll than the recording region. Furthermore, a cutter cuts the recording material by the image after the recording region is fixed.

The thermal head extends crosswise to the feeding path. The shutter segments respectively extend crosswise to the feeding path, and are arranged in a direction along the feeding path.

The liquid crystal shutter unit includes first and second groups of electrodes, the first and second groups being connected with the controller, and disposed opposite to each other with reference to the feeding path.

Furthermore, a cooling unit or heat dissipating unit is disposed between the photo fixer and the liquid crystal shutter unit, for passing the electromagnetic rays, and for dissipating heat generated by the photo fixer.

The photo fixer includes a fluorescent lamp, and the electromagnetic rays are ultraviolet or visible.

The cooling unit or heat dissipating unit contacts a ray emitting surface of the photo fixer, and has a size larger than the ray emitting surface.

The cooling unit or heat dissipating unit includes a cooling unit casing disposed to extend crosswise to an optical path of the electromagnetic rays from the photo fixer to the liquid crystal shutter unit. Transparent fluid has high heat conductivity, is enclosed in the cooling unit casing.

The cooling unit casing includes a panel portion positioned backwards with reference to the optical path. A connection opening is formed in the panel portion, and has the photo fixer fitted therein. The transparent fluid contacts the ray emitting surface.

The cooling unit casing includes a panel portion positioned forwards with reference to the optical path, provided with the liquid crystal shutter unit secured thereto. A first opening is formed in the panel portion, for constituting the optical path.

The transparent fluid is ethylene glycol.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
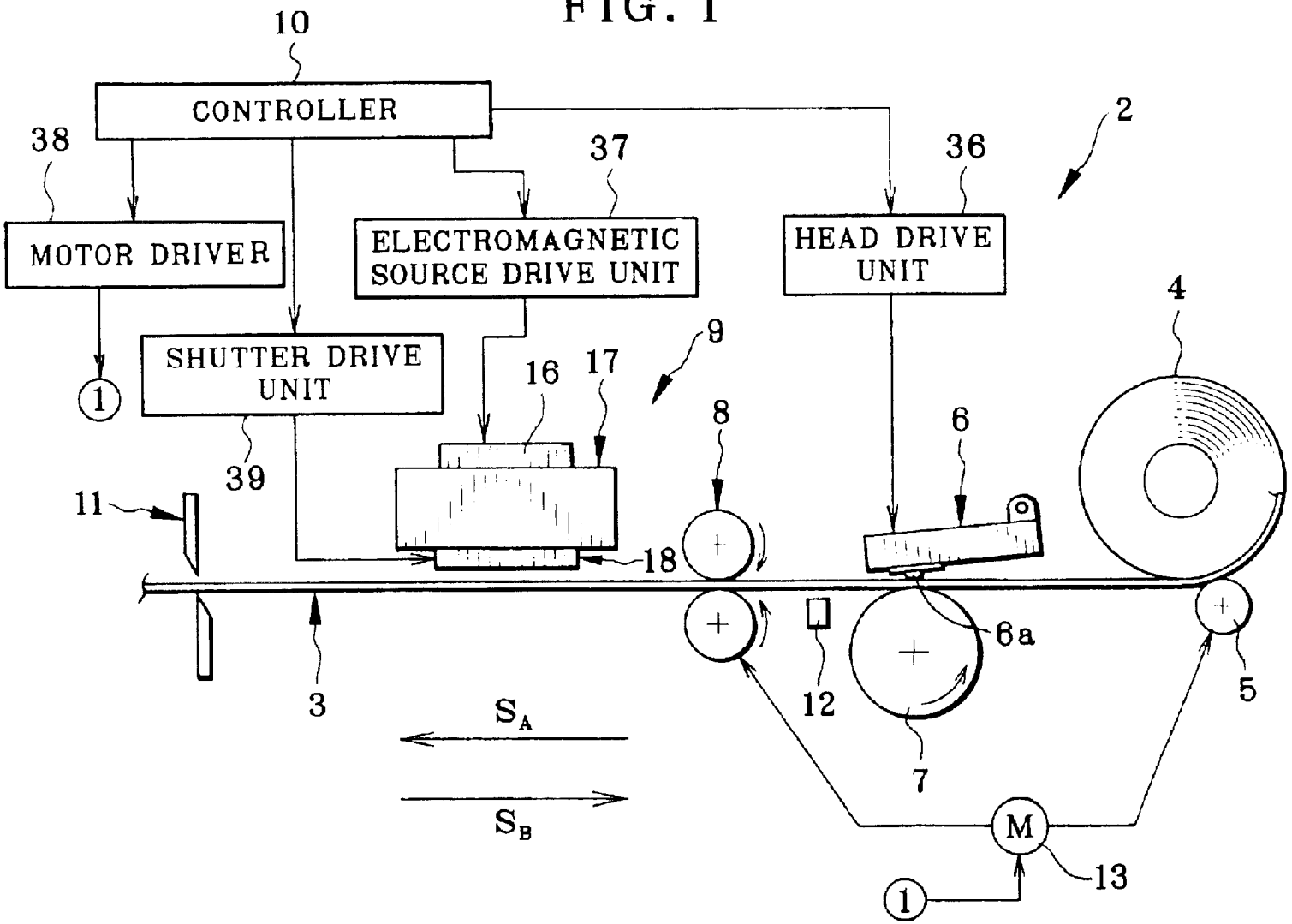
FIG. 1 is an explanatory view illustrating a color thermal printer.

In FIG. 1, a color thermal printer 2 is depicted. Color thermosensitive recording material 3 is transported in a forward direction SA and a backward direction SB, and subjected to thermal recording of a full-color image and photo fixation of the image on the recording material 3.

The recording material 3 includes a support of paper and three thermosensitive coloring layers overlaid thereon. The coloring layers are at least yellow, magenta and cyan coloring layers. The sequence of those is yellow, magenta and cyan as viewed from the surface toward the support. Among the three, the yellow coloring layer has the highest heat sensitivity. The cyan coloring layer has the lowest heat sensitivity.

The yellow and magenta coloring layers are provided with photo fixability responsive to electromagnetic rays of particular wavelength ranges, which are ultraviolet rays or visible violet rays. When near ultraviolet rays or visible violet rays with a wavelength of approximately 420 nm are applied to the recording material 3, the yellow coloring layer is fixed. When ultraviolet rays with a wavelength of approximately 365 nm are applied to the recording material 3, the magenta coloring layer is fixed.

To load the thermal printer 2 with the recording material 3, a recording material roll 4 of the recording material 3 is set. A supply roller 5 is driven to rotate. Thus, the recording material roll 4 is unwound by the supply roller 5 and fed in a feeding path.

A thermal head 6 and a photo fixer 9 are disposed on the feeding path. The thermal head 6 and the photo fixer 9 extend in a main scan direction M which is perpendicular to a sub scan direction S in which the feeding path extends. This is effective in reducing a back-to-front size of the thermal printer.

A heating element array 6*a* is included in the thermal head 6, and has a great number of heating elements arranged in the main scan direction M, which is well-known in the art. The heating element array 6*a* is caused to heat and pressurize the recording material 3, and records an image with heat. Each of the heating elements generates heat energy according to pixel density of each of the three colors, and develops the yellow, magenta and cyan colors to the coloring layers in the recording material 3. A platen roller 7 is opposed to the thermal head 6, and supports the recording material 3 under the thermal head 6.

A feeder roller set 8 with two rollers nips the recording material 3, and feeds the recording material 3 in the sub scan direction S. During the feeding, the thermal head 6 and the photo fixer 9 are driven for the printing and photo fixation as the recording material 3 moves past those. After the printing and fixation, a cutter 11 cuts the recording material 3 to obtain a sheet of a predetermined size, which is ejected to the outside of the thermal printer 2.

Note that the feeder roller set 8 may be disposed downstream from the photo fixer 9 as viewed in the forward direction SA. This makes it possible to shorten the interval between the photo fixer 9 and the thermal head 6. It has been found according to experiments that a reaction rate of fixation of the recording material 3 is made higher when more heat is applied to it. Therefore, the short interval between the photo fixer 9 and the thermal head 6 enables the photo fixation with the recording material 3 kept at a high temperature. It is possible to prevent the shortage in the fixation.

A feeder motor 13 in a feeder drives the feeder roller set 8 and the supply roller 5. An example of the feeder motor 13 is a stepping motor which rotates at a regular amount according to the number of drive pulses input thereto. An end detecting photo sensor 12 detects a front end of the recording material 3 photoelectrically. A controller 10 is supplied by the end detecting photo sensor 12 with a detection signal upon the detection. In response to receipt of the detection signal, the controller 10 counts the drive pulses of the feeder motor 13 up or down. Also, the controller 10 controls amounts of transport of the recording material 3 in the forward and backward directions.

The photo fixer 9 is positioned downstream from the thermal head 6 as viewed in the forward direction SA. A recording region 30 of the recording material 3 after the recording with the thermal head 6 is sent to the photo fixer 9, and fixed electromagnetically. In the fixation, the recording material 3 is fed until a rear edge of the recording region 30 of the recording material 3 is moved past the photo fixer 9. Therefore, the entirety of all of the recording region 30 can be fixed in a regularized manner.

Figure 2:
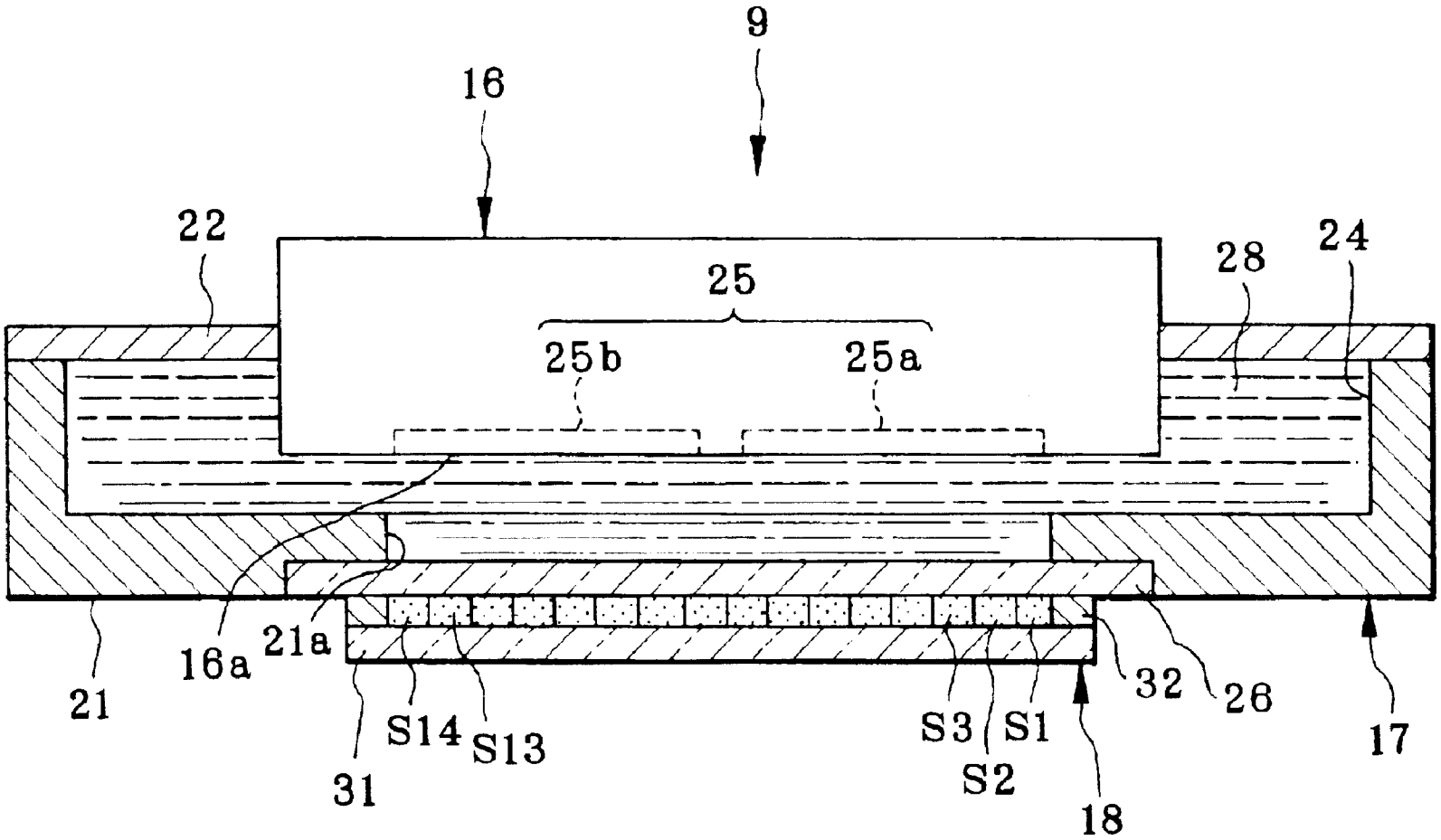
FIG. 2 is a cross section illustrating a combination of a photo fixer, liquid crystal shutter unit, and heat dissipating cooling unit.

In FIG. 2, the photo fixer 9 is constituted by a fluorescent lamp or electromagnetic source 16, and a heat dissipating cooling unit 17 or heat sink for cooling a ray emitting surface of the fluorescent lamp 16 according to natural cooling by conduction of heat. A liquid crystal (LCD) shutter unit 18 is disposed in front of the photo fixer 9. An example of the fluorescent lamp 16 is a flat panel fluorescent lamp.

The fluorescent lamp 16 has a tightly enclosed vessel including a positive electrode panel and a negative electrode panel. A fluorescent film 25 is formed on an inner surface of the positive electrode panel. A ray emitting surface 16*a* is constituted by an outer surface of the positive electrode panel. The tightly enclosed vessel accommodates a filament and a grid electrode. The filament emits an electron beam. The grid electrode controls and scans the electron beam. The positive electrode panel is constituted by a transparent flat glass plate and the fluorescent film 25 formed thereon. When voltage is applied to the filament, the filament emits an electron beam, which impinges on the fluorescent film 25 to emanate electromagnetic rays by excitation.

The fluorescent film 25 includes violet ray emitting phosphor 25*a* and ultraviolet ray emitting phosphor 25*b* for a shorter wavelength. The violet ray emitting phosphor 25*a* emits visible violet rays of which a wavelength peaks at 420–450 nm optimally for fixing the yellow coloring layer. The ultraviolet ray emitting phosphor 25*b* emits ultraviolet rays of which a wavelength peaks at 365–390 nm optimally for fixing the magenta coloring layer. The ray emitting phosphors 25*a* and 25*b* are scanned selectively by use of an electron beam, and caused to emit the fixing rays. Therefore, the yellow and magenta coloring layers in the recording material 3 are fixed.

The heat dissipating cooling unit 17 has a cooling unit casing 24, which is constituted by a cooling unit casing body 21 and an upper lid panel 22. The cooling unit casing body 21 includes a lower panel portion. Transparent liquid 28 as coolant, refrigerant or heat dissipating fluid is filled in the cooling unit casing 24 for cooling the ray emitting surface 16*a* of the fluorescent lamp 16. Also, a portion of the fluorescent lamp 16 with the ray emitting surface 16*a* is contained in the cooling unit casing 24.

It is general that efficiency in emission of rays in the fluorescent lamp 16 drops if the ray emitting surface 16*a* develops remarkably great heat. Also, the phosphor is likely to degrade and to have a shorter life if subjected to high temperature. In consideration of this, the heat dissipating cooling unit 17 cools the ray emitting surface 16*a* and prevents such difficulties.

The cooling unit casing 24 is closed by fitting the lid panel 22. A connection opening is formed in the lid panel 22 for positioning the fluorescent lamp 16. There is packing, adhesive agent or other suitable materials filled in a small gap between the fluorescent lamp 16 and the inside of the connection opening. So the transparent liquid 28 is kept from leaking out of the gap. The lid panel 22 is attached to the cooling unit casing body 21 firmly with adhesive agent, to enclose the cooling unit casing 24 with a reliable tightness.

A first opening 21*a* is formed in a lower panel portion of the cooling unit casing 24. A transparent plate 26 is fitted in the first opening 21*a*. An example of the transparent plate 26 is a flat glass plate. A preferable example of glass material for the transparent plate 26 is quartz glass, because of high resistance to temperature, and high transmittance for ultraviolet rays. Rays emitted by the fluorescent lamp 16 in the cooling unit casing 24 pass through the transparent plate 26, and are applied to the recording material 3.

The transparent liquid 28 is a suitable liquid, for example ethylene glycol. Alternatively, the transparent liquid 28 may be other liquid materials, or mixture of ethylene glycol with other liquid materials. Also, gaseous material may be used instead of the transparent liquid 28. The cooling unit casing body 21 is formed from material having high heat conductivity, such as aluminum or other metal.

The LCD shutter unit 18 is disposed under the cooling unit casing body 21. In the course of photo fixation, the recording material 3 is fed until a rear end of the recording region 30 moves past the photo fixer 9. There has been a problem in that an unused region 35 before being used is likely to receive the fixing rays, as located directly adjacent to the recording region 30. In consideration of this, the LCD shutter unit 18 is disposed between the fluorescent, lamp 16 and the recording material 3, and intercepts fixing rays directed toward the unused region 35.

In the LCD shutter unit 18, a tightly enclosed body is constituted by the transparent plate 26, a front glass panel 31 and a frame 32. The transparent plate 26 is a glass plate for supporting the rear of the LCD shutter unit 18. A light polarization filter is associated with each of the transparent plate 26 and the front glass panel 31. The enclosed body accommodates electrodes, orientation films, and liquid crystal materials.

Figure 3:
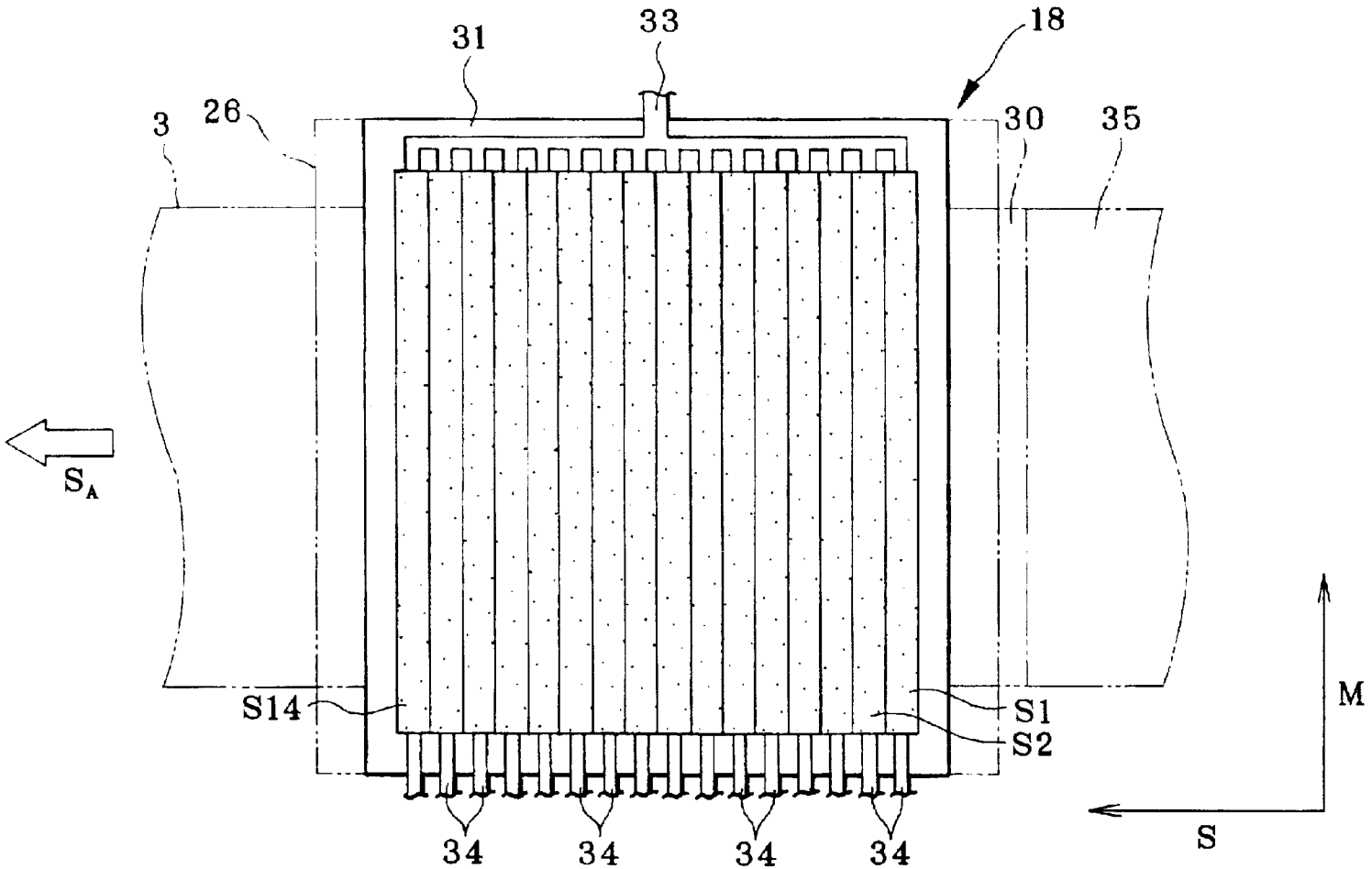
FIG. 3 is a top plan illustrating the liquid crystal shutter unit together with recording material.

In FIG. 3, the LCD shutter unit 18 includes a plurality of shutter segments or liquid crystal segments S1–S14 respectively extending in the main scan direction M. Those are driven independently, and changed over between a transparent state and an opaque state. Each of the shutter segments S1–S14, when in the transparent state, causes the fixing rays from the fluorescent lamp 16 to pass, and when in the opaque state, blocks passage of the fixing rays.

Before the start of the photo fixation, the shutter segments S1–S14 are all open. The recording region 30 of the recording material 3 after printing enters the space opposed to the photo fixer 9, and starts being fixed electromagnetically. After the start of the fixation, the shutter segments S1–S14 are shut in the sequence of S1, S1, S3, . . . , S14, or according to closeness to the thermal head 6 in synchronism with feeding of the recording material 3, or with passage of the rear edge of the recording region 30 in positions opposed to the shutter segments S1–S14. Thus, the fixing rays are intercepted in paths toward the unused region 35 in emanation from the photo fixer 9. In the present embodiment, the number of the shutter segments are 14. However, the number of the shutter segments may be more or less than 14. The width and the number of the shutter segments are appropriately predetermined.

The LCD shutter unit 18 has plural electrodes, which include a common group of electrodes 33 and a separate group of electrodes 34. The common group of the electrodes 33 are connected with all of the shutter segments S1–S14 in a serial manner. The separate group of the electrodes 34 are connected in parallel with the shutter segments S1–S14 in an independent manner. The common group of the electrodes 33 and the separate group of the electrodes 34 are disposed on sides close to lateral edges of the feeding path for the recording material 3. This is effective in reducing the length of the feeding path of the printer. Also, no disposition of the electrodes in the sub scan direction S is required for the photo fixer 9. This makes it possible to shorten the interval from the thermal head 6 to the photo fixer 9.

This being so, the use of the LCD shutter unit 18 simplifies the structure in comparison with a mechanical shutter known in the prior art. The printer can have a reduced size. It is not necessary to dispose a light-shielding screen or its rail between the photo fixer 9 and the recording material 3. A range of emitting the fixing rays can be shortened. Also, a cost of the LCD shutter unit 18 is relatively low, so that a manufacturing cost of the thermal printer can be reduced.

The LCD shutter unit 18 is disposed under the heat dissipating cooling unit 17, and can be made cool by the heat dissipating cooling unit 17. Because of the transparent plate 26 constituted by a glass plate, the cooling effect of the heat dissipating cooling unit 17 is high. It is to be noted that, in the present invention, the transparent plate 26 of glass may not be used on the side contacting the heat dissipating cooling unit 17.

The thermal printer includes a head drive unit 36, an electromagnetic source drive unit 37, a motor driver 38, a shutter drive unit 39 and a cutter drive unit (not shown), which are controlled by the controller 10 for printing operation.

The operation of the above embodiment is described now. To produce a print in the thermal printer 2, the recording material roll 4 is set at first. A command signal for printing is input. Then the recording material 3 is supplied and fed through the feeding path. The thermal head 6 thermally records a yellow image to the yellow coloring layer. A portion of the recording material 3 after the printing is fed to the photo fixer 9, and starts being fixed electromagnetically.

The fluorescent lamp 16 is driven to emit yellow fixing rays. Before fixation of the yellow, all of the shutter segments S1–S14 are open. The yellow fixation is started in this state. The controller 10 operates in synchronism with movement of a rear end of the recording region 30 of the recording material 3 past the position of the LCD shutter unit 18, and shuts the shutter segments in the sequence of S1, S2, S3, . . . , until all of the shutter segments S1–S14 are shut.

Thus, the entirety of the recording region 30 can be fixed by the rays in a regularized manner. No fixing rays for the yellow are applied to the unused region 35 that is adjacent to the recording region 30. Therefore, there occurs no waste of the recording material 3 as the unused region 35 can be used for next printing in a reliable manner.

When the recording and fixation of the yellow color are completed, the recording material 3 is moved in reverse to the forward direction. The fluorescent lamp 16 is turned off. The shutter segments S1–S14 are all opened. Then the recording material 3 is fed in the forward direction again, to record the magenta color thermally.

The fluorescent lamp 16 is driven again, to emit fixing rays for the magenta. The portion of the recording material 3 after the magenta recording is fed to the photo fixer 9, and starts being fixed electromagnetically. In the same manner as the yellow fixation, the controller 10 operates in synchronism with movement of the rear end of the recording region 30 of the recording material 3 past the position of the LCD shutter unit 18, and shuts the shutter segments in the sequence of S1, S2, S3, . . . . Then all of the shutter segments S1–S14 are shut.

When the recording and fixation of the magenta color are completed, the recording material 3 is moved in reverse to the forward direction, and then moved in the forward direction again. In the forward movement, the cyan color is recorded. Upon completion of the cyan recording, the recording region 30 of the recording material 3 is cut to form a sheet, which is ejected. The unused region 35 is wound back to the recording material roll 4, and will be used for producing another print.

In the above embodiment, the single photo fixer emits both the yellow and magenta fixing rays. However, two separate photo fixers may be used for yellow fixation and magenta fixation. For this structure, two LCD shutter units 18 are used.

In the above embodiment, a flat fluorescent lamp is used as an electromagnetic source in the photo fixer 9. However, other types of electromagnetic sources may be used. Examples of electromagnetic sources include a plasma display panel, a light-emitting element array, for example, an array of a great number of light-emitting diodes, electro luminescence (EL) elements, or the like. Furthermore, an electromagnetic source may be a type different from a flat panel electromagnetic source, for example, may be a fluorescent lamp in a form of a straight tube.

Note that, in spite of above embodiment, the heat dissipating cooling unit 17 may be omitted from the photo fixer 9, which may be used without being cooled. For this structure, the LCD shutter unit 18 is fixedly kept opposed to the ray emitting surface 16*a* of the photo fixer 9 by use of brackets or other support elements.

In the above embodiment, the heat dissipating cooling unit 17 or heat sink contains the transparent liquid 28 enclosed without a flow. This is for natural cooling. Note that additional elements for dissipating heat may be provided on the heat dissipating cooling unit, for example, a heat dissipating fin, heat exchanger, fan for flowing of air, and the like. Furthermore, a device with such elements may be substituted for the heat dissipating cooling unit 17 of the above embodiment. For example, a cooling device may be disposed in place of the heat dissipating cooling unit 17, in which the transparent liquid 28 or gas as coolant may be circulated in the cooling unit casing 24.

In the above embodiment, the LCD shutter unit 18 is disposed outside the heat dissipating cooling unit 17. Alternatively, the LCD shutter unit 18 may be disposed inside the heat dissipating cooling unit 17. This is additionally effective in preventing occurrence of electrostatic charge in the recording paper, because the electrostatic charge generated by the LCD shutter unit 18 can be discharged through a path of any panel portion of the heat dissipating cooling unit 17.

In the above embodiment, the heat dissipating cooling unit 17 has the first opening 21*a* formed in the cooling unit casing 24. However, the first opening 21*a* may be omitted. The LCD shutter unit 18 may be kept secured to the heat dissipating cooling unit 17 and also may be disposed with a small distance from the heat dissipating cooling unit 17. If the first opening 21*a* is omitted, however, it is necessary to form the entirety of the cooling unit casing 24 from a transparent material, so as to pass the fixing rays. Therefore, the construction of the LCD shutter unit 18 positioned under the first opening 21*a* according to the above embodiment is advantageous because of the structural simplicity.

In the above embodiment, the transparent liquid 28 is stored in a direct contact with the ray emitting surface 16*a*. However, the lid panel 22 may be transparent, and may not have a central connection opening. The lid panel 22 may be closed to extend entirely between the ray emitting surface 16*a* and the transparent liquid 28, and may have an upper surface contacting the ray emitting surface 16*a*. It is still possible to conduct heat from the ray emitting surface 16*a* through the lid panel 22 to the transparent liquid 28 for efficient dissipation.

In the above embodiment, the plural shutter segments S1–S14 in a long shape are used. Note that each of the plural shutter segments in the LCD shutter unit 18 may be a single liquid crystal cell having a long shape and not dividable into parts, and furthermore, may be a train of numerous liquid crystal cells among those arranged in a matrix and controllable in a completely independent manner.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer comprising:

a feeder for feeding thermosensitive recording material unwound from a recording material roll through a feeding path;

a thermal head for thermal recording of an image in a recording region of said recording material being fed;

a photo fixer for fixing said image on said recording material by application of electromagnetic rays thereto;

a liquid crystal shutter unit, disposed between said photo fixer and said recording material, and including plural shutter segments wherein said plural shutter segments are changeable between an opaque state and a transparent state independently from one another, and when in said opaque state, block said electromagnetic rays, and when in said transparent state, cause said electromagnetic rays to pass; and a controller for controlling said liquid crystal shutter unit in synchronism with said feeder, for setting at least one of said shutter segments in said transparent state if said at least one is opposed to said recording region in feeding of said recording material, and for setting at least one of said shutter segments in said opaque state if said at least one is opposed to an unused region in feeding of said recording material, wherein said unused region is defined upstream from and adjacent to said recording region;

wherein said thermal head extends crosswise to said feeding path, and said shutter segments respectively extend crosswise to said feeding path, and are arranged in a direction along said feeding path.

2. A thermal printer as defined in claim 1, further comprising a cutter for cutting said recording material by said image after said recording region is fixed.

3. A thermal printer as defined in claim 1, wherein said liquid crystal shutter unit includes a common electrode and plural individual electrodes, said plural individual electrodes being connected with said controller, and disposed opposite to each other with reference to said feeding path.

4. A thermal printer as defined in claim 3, further comprising a cooling unit, disposed between said photo fixer and said liquid crystal shutter unit, for passing said electromagnetic rays, and for dissipating heat generated by said photo fixer.

5. A thermal printer as defined in claim 4, wherein said cooling unit includes:

a cooling unit casing body in a box shape of which an upper side is open;

a first opening formed in a lower side of said cooling unit casing body, wherein said liquid crystal shutter unit is secured to said cooling unit casing body in a manner to close said first opening;

transparent fluid, contained in said cooling unit casing body, and having high heat conductivity;

a lid panel secured to said cooling unit casing body; and a connection opening, formed in said lid panel, and having said photo fixer fitted therein so as to extend a ray emitting surface of said photo fixer into said transparent fluid.

6. A thermal printer as defined in claim 5, wherein said photo fixer comprises a flat panel electromagnetic source, and said ray emitting surface comprises a flat surface in a quadrilateral shape.

7. A thermal printer as defined in claim 6, further comprising phosphors of two types, overlaid on said flat surface to constitute fluorescent film, for emitting said electromagnetic rays of respective wavelength ranges upon excitation of electron.

8. A thermal printer as defined in claim 6, wherein said transparent fluid is ethylene glycol.

* * * * *